US010017283B2

(12) United States Patent
Kastner

(10) Patent No.: US 10,017,283 B2
(45) Date of Patent: Jul. 10, 2018

(54) DEVICE AND SYSTEM FOR APPLYING EDGE PROTECTORS ON A STRAPPED PACKAGE

(71) Applicant: SPG Packaging Systems GmbH, Dinslaken (DE)

(72) Inventor: Hans Günther Kastner, Wülfrath (DE)

(73) Assignee: Signode Industrial Group LLC, Glenview, IL (US)

( * ) Notice: Subject to any disclaimer, the term of this patent is extended or adjusted under 35 U.S.C. 154(b) by 445 days.

(21) Appl. No.: 14/921,770

(22) Filed: Oct. 23, 2015

(65) Prior Publication Data

US 2016/0114918 A1 Apr. 28, 2016

(30) Foreign Application Priority Data

Oct. 24, 2014 (DE) ..... 10 2014 221 628

(51) Int. Cl.
*B65B 13/18* (2006.01)

(52) U.S. Cl.
CPC ..... *B65B 13/181* (2013.01)

(58) Field of Classification Search
CPC ..... B65B 13/04; B65B 13/181; B65B 13/20
USPC ..... 53/580, 582, 589, 139.6, 139.7; 100/8
See application file for complete search history.

(56) References Cited

U.S. PATENT DOCUMENTS 3,271,925 A * 9/1966 Aubery ..... B29B 7/566 100/27
4,897,980 A * 2/1990 Geyser ..... B65B 5/028 53/128.1
5,289,668 A * 3/1994 Meyer ..... B65B 13/181 53/139.7
5,546,730 A * 8/1996 Newell ..... B65B 11/585 53/139.7
5,564,254 A * 10/1996 Thimon ..... B65B 11/025 53/139.6
6,775,956 B1 * 8/2004 Lacey ..... B65B 11/585 53/156

(Continued)

FOREIGN PATENT DOCUMENTS

DE 9311406 U1 11/1933
DE 2431153 A1 1/1976

(Continued)

*Primary Examiner* — Hemant M Desai
*Assistant Examiner* — Valetin Neacsu
(74) *Attorney, Agent, or Firm* — Levenfeld Pearlstein, LLC

(57) ABSTRACT

A device arranges an edge protector on a package. The device includes a drive wheel for moving the device along a guiding rail from a point of departure to the package and from the package to the point of departure. A motor is carried by the device and drives the drive wheel. A clamp mount includes a movable clamping jaw and a counter bearing for taking up the edge protector in an open position of the clamping jaw and to hold it in a closed position of the clamping jaw. The motor drives the drive wheel and acts on a power transmission assembly to induce opening and closing of the clamping jaw. A device for strapping packages having the edge protector applicator includes a frame carrying a press plate above a vertically movable packing table. The press plate has running rails on which the edge protector applicator is movably mounted. The applicator device is mounted below the press plate.

14 Claims, 6 Drawing Sheets

(56) References Cited

U.S. PATENT DOCUMENTS

| | | | | |
|---|---|---|---|---|
| 7,237,478 | B1 * | 7/2007 | Gosis | B65B 13/06 100/26 |
| 7,428,865 | B1 * | 9/2008 | Kasel | B65B 13/04 100/26 |
| 2002/0014052 | A1 * | 2/2002 | Suolahti | B65B 13/181 53/139.7 |
| 2003/0006012 | A1 * | 1/2003 | Lai | B65B 13/06 156/443 |
| 2004/0261360 | A1 * | 12/2004 | Cere | B65B 11/025 53/410 |
| 2005/0108989 | A1 * | 5/2005 | Dickner | B65B 13/181 53/445 |
| 2012/0055123 | A1 * | 3/2012 | Brunson | B65B 9/135 53/558 |

FOREIGN PATENT DOCUMENTS

| | | | |
|---|---|---|---|
| DE | 202012004335 | U1 | 8/2013 |
| DE | 202013002503 | U1 | 6/2014 |

* cited by examiner

DEVICE AND SYSTEM FOR APPLYING EDGE PROTECTORS ON A STRAPPED PACKAGE

The invention relates firstly to a device to arrange an edge protection means on a package, with at least one drive wheel with which the means is movable along a running rail from a point of departure to the package and from the package to the point of departure, with a motor carried by the means itself and which sets at least one drive wheel in motion, with a clamp mounting comprising a movable clamping jar and a counter bearing to take up the edge protection means in an open position of the clamping jaw and hold it in a closed position of the clamping jaw.

Means to arrange edge protection means on packages are used in strapping arrangements. For example, such strapping arrangements are used to secure products on load carriers, in particular to secure pallets for transportation with strapping bands. Alternatively, it is also known to strap packages—such as packaging cartons—with a band prior to transportation to prevent the carton from opening during transportation. Since the strapping means is tightened around the package during the strapping process, strong forces are acting upon the package edges. This can cause damage to the package. To prevent this, so-called edge protection means are applied in the area of the edges. In the simplest case, these are flat cardboard strips applied to the package, for example with the arrangement means according to the invention and described below, and held in the area of the edge. During the strapping process, the flat cardboard strips are usually bent by the strapping means itself along the package edge and laid around the edge. The edge protection means runs between the strapping means and the package, thus preventing damage to the latter.

The Applicant firm itself has in the recent past produced numerous developments in this field, mainly for the purpose of providing arranging means for strapping arrangements that are simple to retrofit. This involves various carriages which can be moved, for example, along guides on the packing table—disclosed in DE 20 2012 004 335 U1—or below the press plate also along guides to the package—disclosed in DE 20 2013 002 503 U1.

The invention is based on the Applicant firm's own 20 3013 002 503 U1 which discloses an arranging means for edge protection means in the form of a carriage which can be moved below the press plate of the strapping arrangement from a point of departure to the package and back again. At the point of departure, an edge protection means is laid into a clamp mounting, arranged on the package and there fastened to the package with the strapping means as described above.

The object of the invention is to provide a simplified arranging means of compact design for edge protection means.

SUMMARY

This object is achieved by a means to arrange an edge protection means with the characteristics of claim 1, in particular with its generic characteristics according to which the motor for driving the at least one drive wheel acts upon at least one power transmission means which induces the opening and closing movement of the clamping jaw.

The substantial advantage of the invention is that it simplifies the design of the hitherto separately controlled clamp mounting. The invention advantageously recognizes that there is no need for the clamping jaw of the clamp mounting to have its own drive if the clamping jaw is coupled with the motor which causes the motion of the arranging means between the point of departure and the package. In addition, the invention demonstrates that there is no need for a separate control of the clamping jaw when the motor drive of the arranging means is used to force the clamping jaw to close and to open the clamping jar when the package is moved in the direction of the point of departure. This eliminates a separate control logic, and the control of the clamping jaw is purely mechanical, accomplished through coupling with the drive of the arranging means.

In concrete terms, it is provided that the power transmission means induces the closing movement of the clamping jaw when the means is moved in the direction of the package and to open it when the means is moved in the direction of the point of departure.

Furthermore, it is provided that the clamping jaw is part of a lever that is pivotable about a swivel axis, and that the motor induces the swivel movement.

In a preferred embodiment it is provided that the power transmission means is a first gear wheel which is preferably positioned on an axis of the drive wheel, particularly when the swivel axis is provided with a second gear wheel that engages in the first gear wheel.

In this preferred embodiment, an especially simple transmission of the propulsion force of the arranging means' motor upon the clamping jaw of the clamp mounting has been chosen in that the rotational movement of the drive axis via the gear wheel on the drive axis side and the gear wheel on the lever side is translated into an opening or closing swivel movement of the clamping jaw lever.

It is also provided that the means, if need be the lever itself, is provided with at least one end stop for the movement, limiting the opening or closing movement of the lever.

In a very advantageous embodiment it is provided that the first gear wheel is positioned on the axis of the drive wheel via a slipping clutch which discards the overload and holds a defined torque when the clamping jar reaches the opening or closing position.

The slipping clutch allows the translation of the drive movement into a closing movement of the clamping jaw or the opening movement of the clamping jar such that a very short travel of the arranging means is sufficient to complete the opening or closing movement. To allow a further movement of the arranging means while maintaining the open or closed position, the slipping clutch is used which, however, maintains a defined torque affecting the clamping jaw.

Another component of the invention is a strapping arrangement for packages comprising the arranging means according to the invention and having the characteristics of sub-claim 8. In addition to using the arranging means according to the invention in the strapping arrangement according to claim 8, the arrangement for strapping can be further improved thanks to the arranging means according to the invention.

Thus it is provided that at the point of departure, the arrangement is provided with a lifting device with which the means for arranging the edge protection means can be lifted out of the running rails to uncouple the opening and closing movement of the clamping jaw from the linear motion of the arranging means.

The substantial advantage of this embodiment is that the lifting device removes the coupling between the drive wheels of the arranging means and the running rails on the device side. Thus, the motor of the arranging means can be set in motion and affect the drive wheels without this causing the operation of the arranging means. Therefore the opening or closing movement of the clamping jaw can be triggered, using the lifting device at the point of departure, without this causing a movement of the arranging means.

As a result, the arranging means can be provided with an edge protection means at the point of departure itself to hold the edge protection means securely clamped without having to travel in the direction of the package. That is how the travel portion of the carriage, otherwise necessary for the closing motion of the clamping jaw, can be saved. Therefore, the strapping arrangement can either have a smaller design or, with the same width, can process wider packages, whereby the width must be measured along the travel path of the arranging means. In summary, this means that the arranging means, thanks to the lifting device can take up an edge protection means at the point of departure itself and subsequently deposit it on a package edge.

It is provided that the lifting device comprises an electromagnet whose magnetic force acts upon a metal coupling part of the arranging means.

The use of an electromagnet has the substantial advantage that it eliminates mechanical components prone to disruption.

Alternatively, it can also be provided that the lifting device comprises a lifting arm which positively engages in a lifting element of the arranging means.

That embodiment is suitable in particular wherever packages are treated which react sensitively to magnetic fields.

DESCRIPTION OF THE FIGURES

Below, the invention is now described with reference to an embodiment, where.

DETAILED DESCRIPTION

Figure 1:
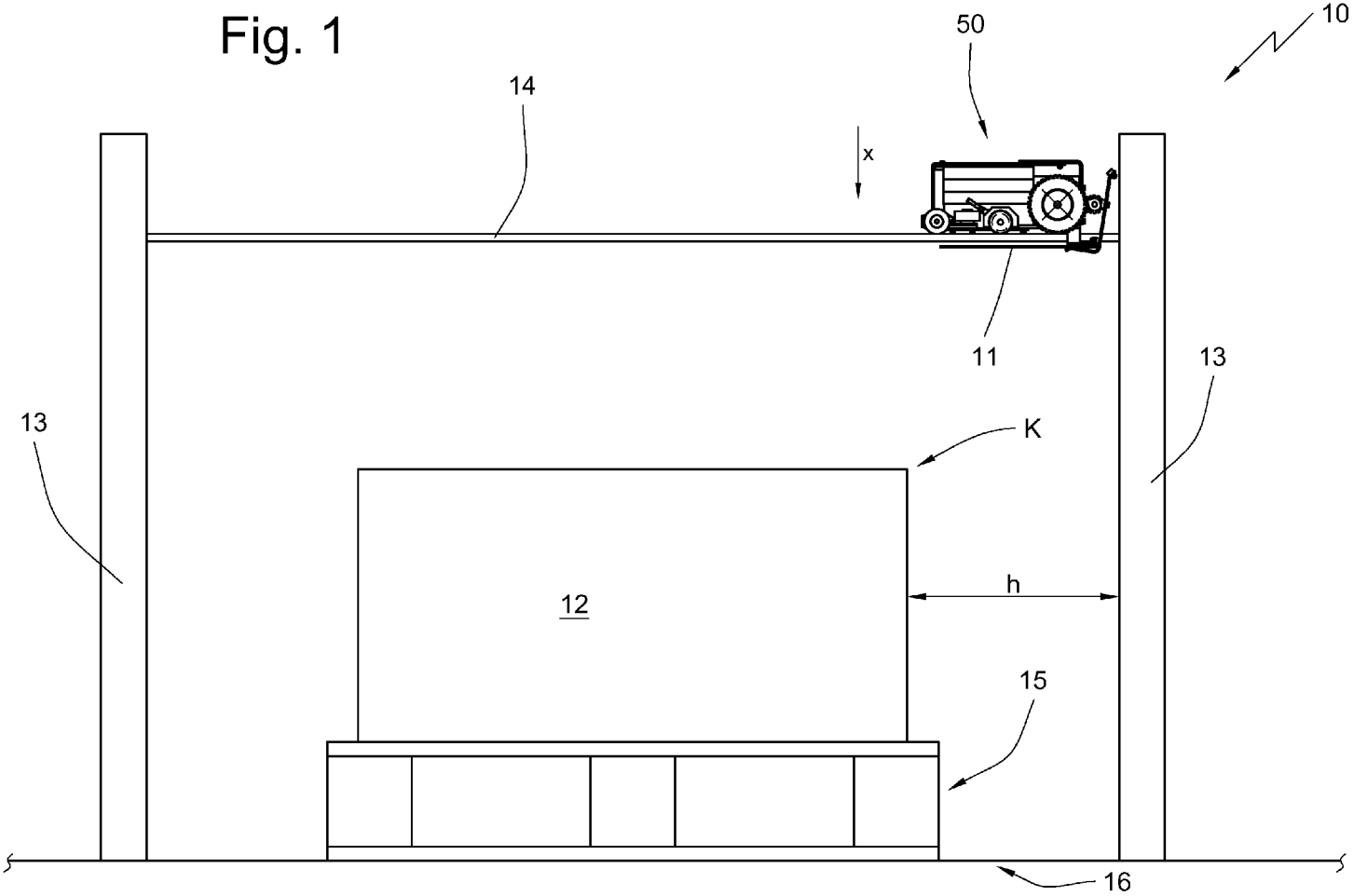
FIG. 1 shows a strapping arrangement with the arranging means According to the invention, at a point of departure.

In the drawings, the entire strapping arrangement for packages is given reference number 10. The entire device for arranging the edge protection means—also called the arranging means—is given reference number 50.

Figure 4:
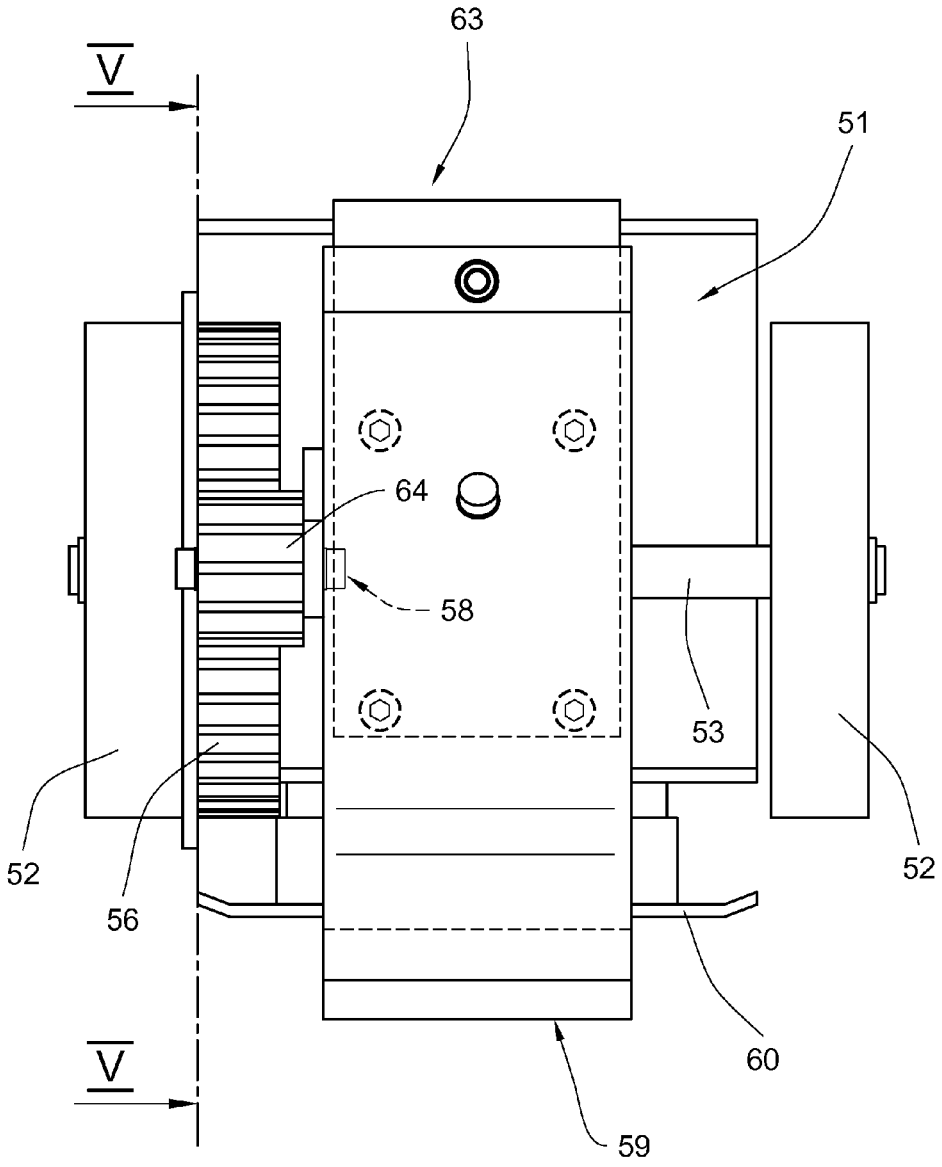
FIG. 4 shows a rear view of the arranging means according to the invention.
Figure 5:
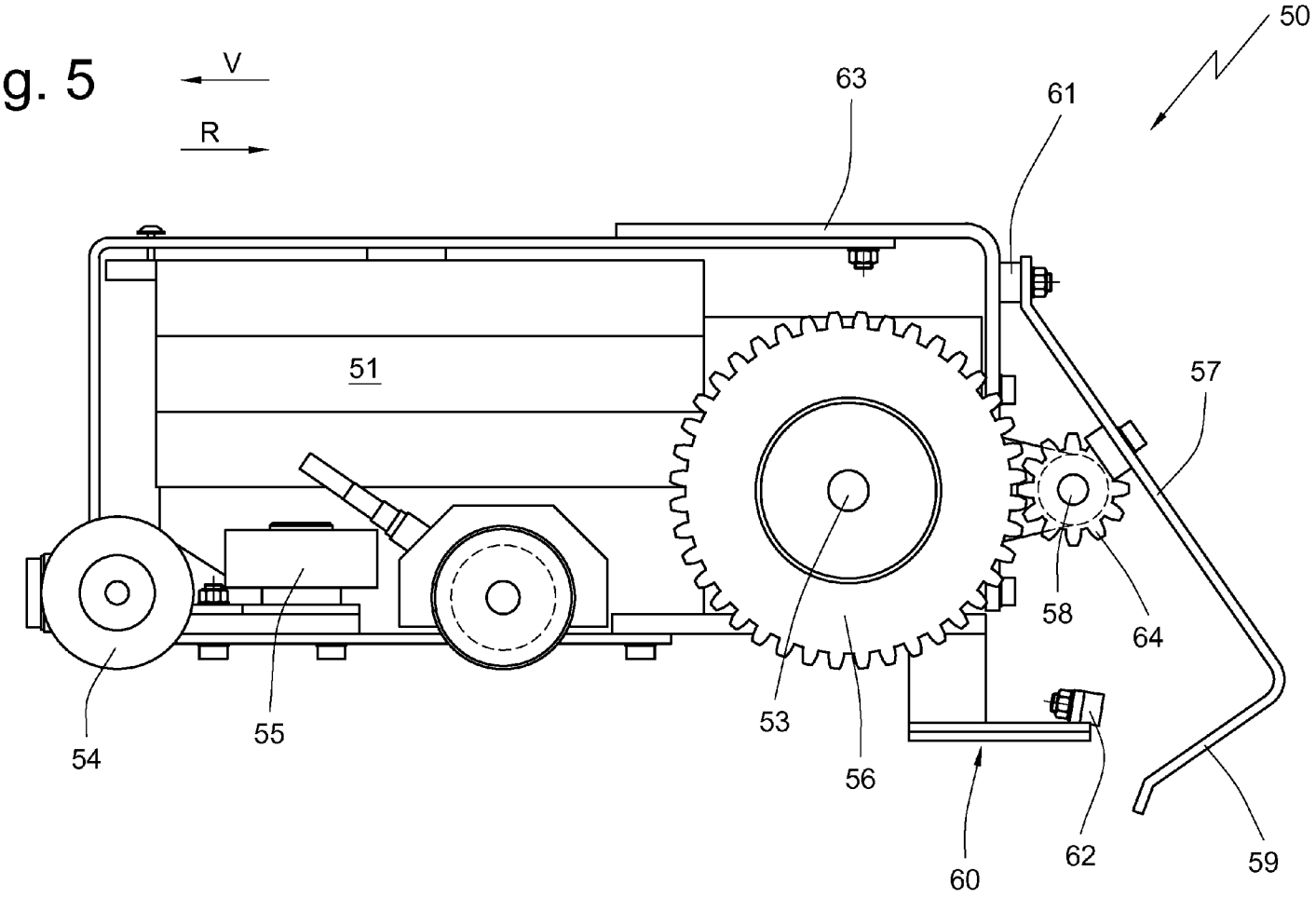
FIG. 5 shows a lateral view of the arranging means according to the invention with a clamping jaw in open position, cut along section V-V in FIG. 4.
Figure 6:
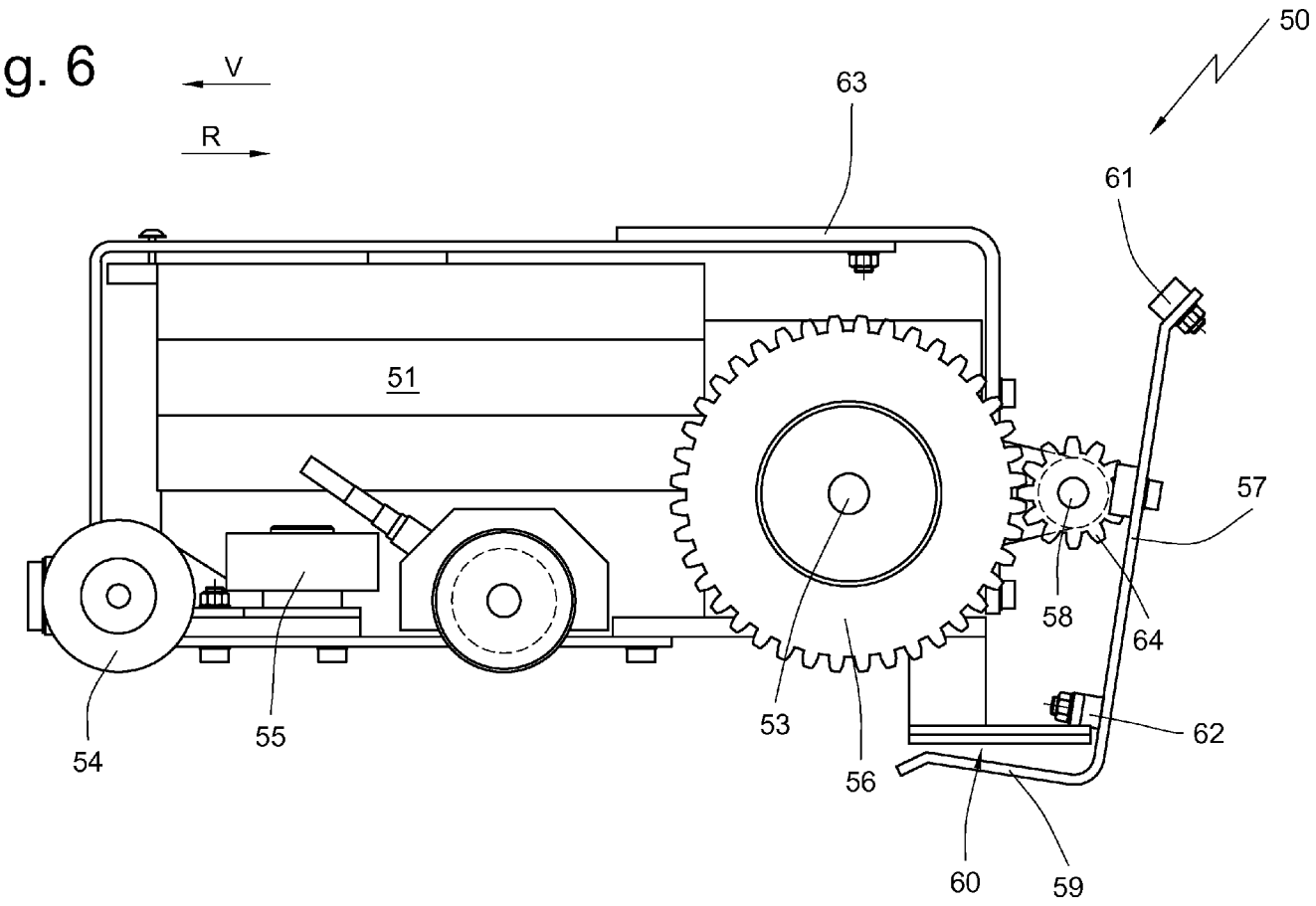
FIG. 6 shows a lateral view of the arranging means according to the invention with the clamping jaw in closed position, cut along section V-V in FIG. 4.

In FIGS. 4 to 6, the arranging means 50 is shown in various views. It will be described below with reference to FIG. 4 to 6.

Shown is an arranging means 50 for edge protection means 11 (see FIGS. 1 to 3) with a drive motor 51. In the embodiment of arranging means 50 shown here, drive motor 51 so to speak forms the chassis on which the substantial components are arranged. These include first of all the drive wheels 52 mounted on a common drive axis 53. Motor 51 drives the drive wheels 52 in forward direction V or reverse direction R and provides for the movement of arranging means 50.

A the forward end in forward direction V of means 50 are non-driven running wheels 54 and guide rollers 55 which provide the lateral guidance of arranging means 50.

At least one first gear wheel 56 is arranged on drive axis 53 by means of a slipping clutch.

At the rear end of arranging means 50 in forward direction V, a lever 57 is attached by means of a swivel axis 58, whereby the lever 57 is pivotable about swivel axis 58. At its bottom end, the lever holds a clamping jar 59 which together with a counter bearing 60 forms a clamp mounting of the arranging means for taking up edge protection means 11.

Fixed to the end of lever 57 opposite clamping jaw 59 is a first rubber bushing 61 as a first end stop for the movement. The second end stop is formed by a second rubber bushing 62. It is fastened to counter bearing 60. Above drive shaft 53 is a metal plate 63 coupled with the motor 51.

Swivel axis 58 carries a second gear wheel 64 engaging in the first gear wheel 56 such that a rotation of the first gear wheel results in rotation of swivel axis 59 and a pivoting movement of lever 57. Since the first gear wheel 56 is arranged on drive axis 53 and co-rotates with it, driving the arranging means 50 in reverse direction R causes lever 57 to pivot together with the closed clamping jaw 59 in open position, as shown in FIG. 5. However, linear motion of the arranging means 50 in forward direction causes a counter-rotating pivoting movement of lever 57 in closed position of the clamp mounting as shown in FIG. 6.

The end stops 61 and 62 limit der pivoting of lever 57. Not to restrict the linear movement of the arranging means after completion of the pivoting movement of lever 57 in open or closed position, it is provided that the first gear wheel 56 is arranged on the first axis 53 with a slipping clutch. Alternatively, the second gear wheel 64 can also be arranged on swivel axis 58 with a slipping clutch. The slipping clutch causes the load to be dropped when the open or closed position of lever 57 is reached while a defined torque is maintained. It means that axis 53 can rotate arranging means 50 in forward direction V or reverse direction R even when gear wheel 56 can no longer rotate by means of lever 57 because it has reached end stop 61 or 62. Maintaining a minimum torque acting upon gear wheel 57 ensures that pivoting lever 57 of the attached clamping jaw 59 stays in open or closed position even while the load is dropped by the slipping clutch.

Figure 2:
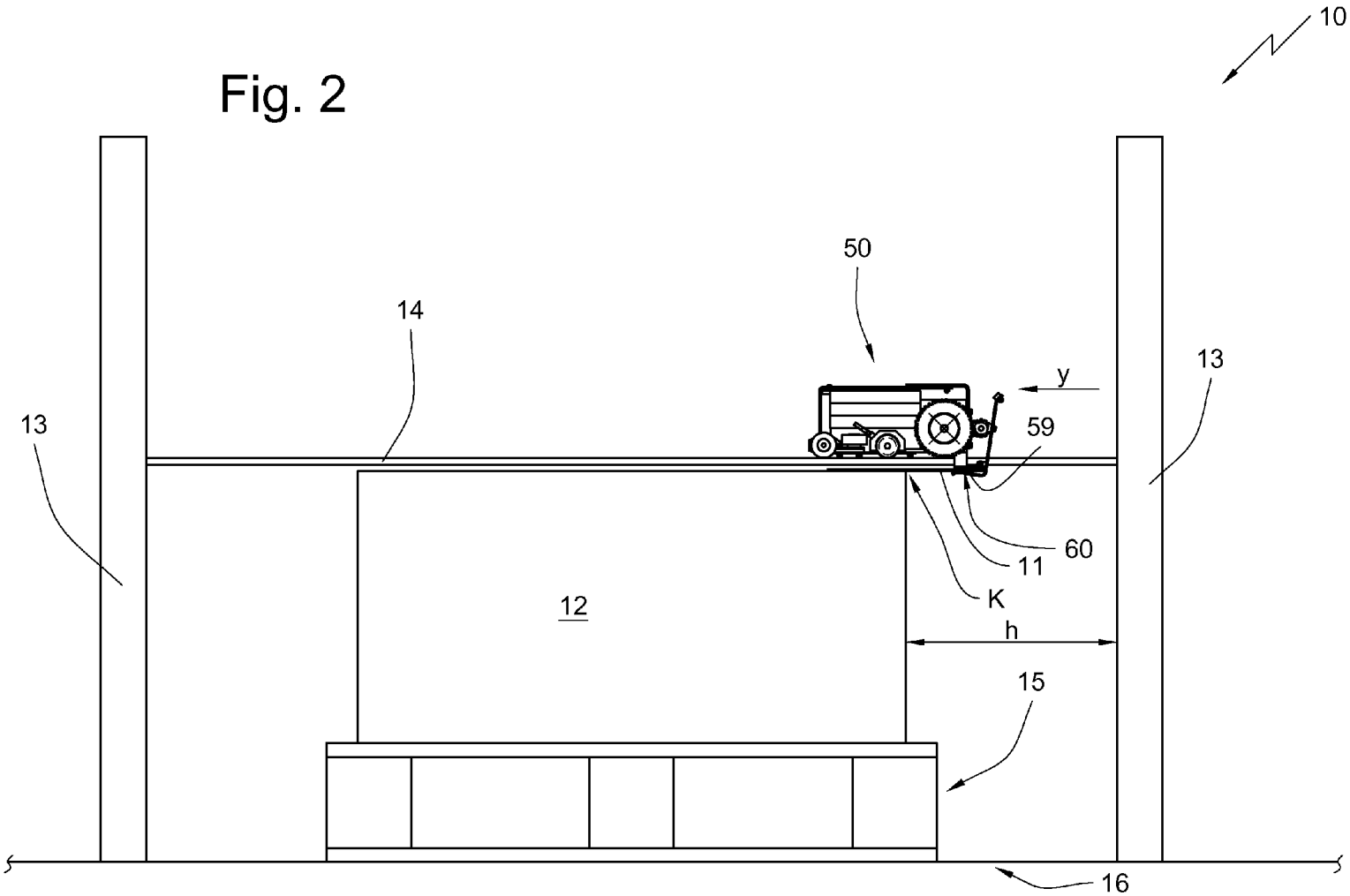
FIG. 2 shows the arrangement according to FIG. 1 with the arranging means on the package.
Figure 3:
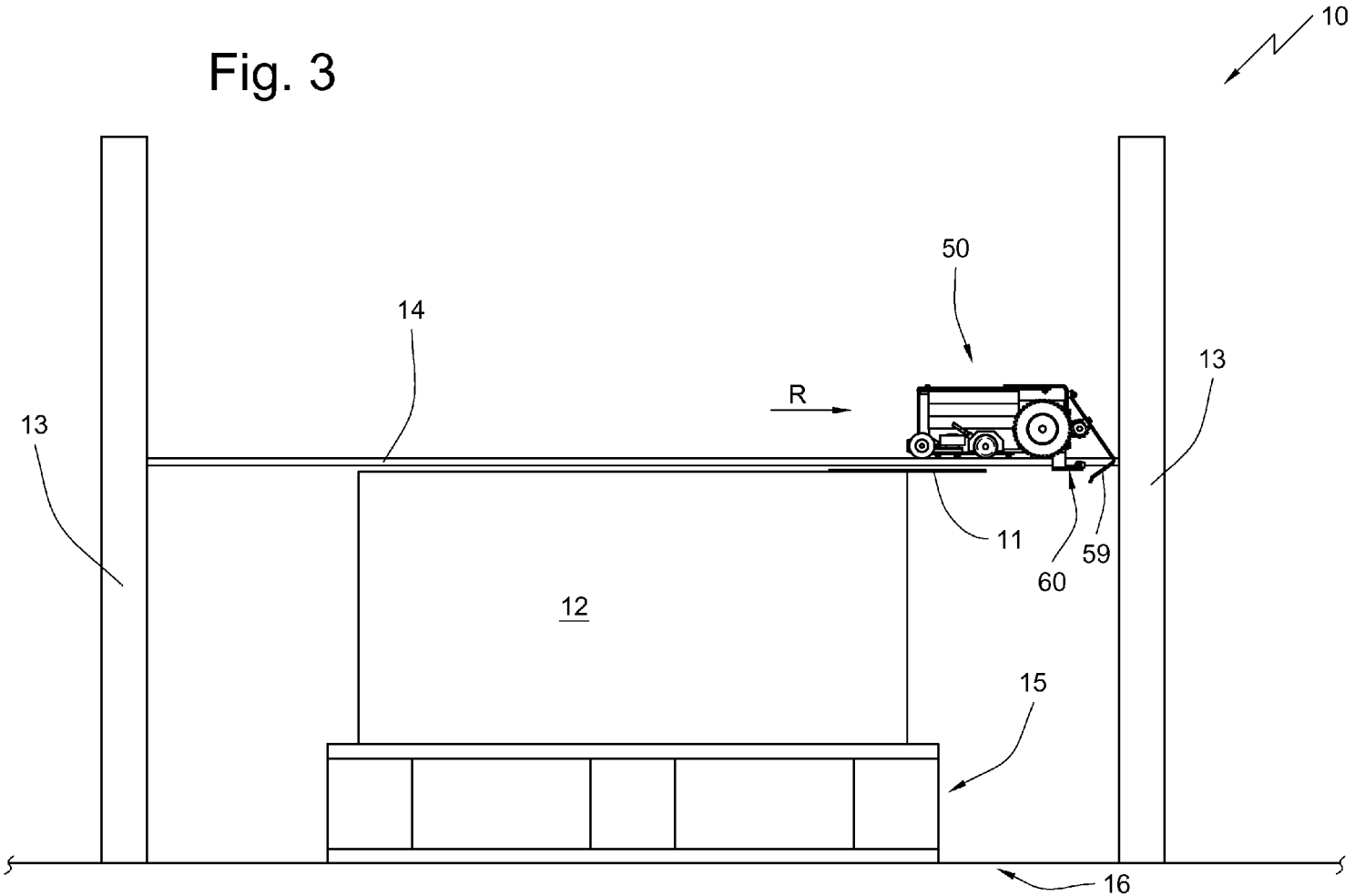
FIG. 3 shows the arrangement according to FIG. 1, again with the arranging means at the point of departure.

FIGS. 1 to 3 show a strapping arrangement 10 using arrangement means 50 to apply an edge protection means 11 to a package 12. In the figures, strapping arrangement 10 is only shown schematically and comprises two supports 13 of a machine frame. A vertically movable horizontal press plate 14 is attached to these vertical supports 13 which are at a distance to each other. Below press plate 14 is the package 12 place on load carrier 15 which is formed like a pallet. The load carrier 15 itself is taken into the paper level on a packing table 16.

Arranging means 50 runs on approximately L-shaped running rails (not shown) arranged on the top side of press plate 14, on the side facing away from packing table 16. The drive wheels 52 and the running wheels 54 bear on the horizontal leg of the running rail. The guide rollers 55 are adjoining the vertical legs of the running rails such that the arranging means 50 is aligned horizontally along the guide rollers 55. A gap is provided in the press plate between the running rails (not shown) through which the clamp mounting—which consists of counter bearing 60 and clamping jaw 59—is led to the side facing package 12. That is why the arranging means 50 runs on the upper side of press plate 14 while only the clamp mounting is below press plate 14.

In FIG. 1, the arranging means 50 is at its point of departure, the clamp mounting is closed, the clamping jaw is in closed position. The clamp mounting is holding an edge protection means 11 between the clamping jaw 59 and the counter bearing 60.

From this point of departure, the press plate 14 is lowered in vertical direction X, the direction of the package 12, whereby a measuring means (not shown) measures the horizontal distance H between the point of departure and of arranging means 50 and a package edge K, then the control calculates the required travel path in forward direction V which the arranging means 50 then travels, to place the edge protection means 11 in the area of the package edge K on the tops side of the package 12—the side facing press plate 14. This situation is shown in FIG. 2 whereby the edge protection means 11 is still held by the clamp mounting of arranging means 50 on the one side and between press plate 14 and the top side of package 12 on the other side.

During the process in forward direction V, the slipping clutch between the first gear wheel 56 and the drive axis 53 maintains a defined torque which acts via the second gear wheel 64 upon lever 57 and thus keeps the clamping jaw 59 in closed position.

Starting from the situation shown in FIG. 2, the control (not shown) induces the arranging means 50 to move back in reverse direction R to the point of departure. This forces the drive axis 53 to move counter to the prior forward direction and causes a counter-rotating movement of the first gear wheel 56. This has the effect that during the reverse movement in direction R the lever 57 pivots and moves the clamping jaw 59 into its opening position. Thus the edge protection means 11 is released by the clamp mounting and is now only held between the press plate 24 and the package 12, such that the strapping process can begin. In a manner not shown, a strapping means is now wrapped package 12, whereby the edge protection means 11 is arranged between the strapping means and the package 12. When the strapping means is tightened around package 12, the edge protection means 11 is formed around package edge 12 so that it adjoins between the strapping means and the package edge K.

After this now completed strapping process, the press plate is vertically lifted opposite to direction X, which releases package 12 which can be removed from strapping arrangement 10.

In a manner not shown, a new edge protection means 11 is inserted at the point of departure in the clamp mounting of the arranging means 50. A slight forward movement of the arranging means 50 in forward direction V closes the clamp mounting and leads to the firm application of the edge protection means 11 such that after a new package 12 is inserted in the strapping means 10, the point of departure of FIG. 1 is reached.

In a manner not shown, the strapping arrangement 10 can have a lifting device on its press plate 14 at the point of departure of arranging means 50. When the arranging means 50 is at the point of departure, it is in the effective range of the lifting device. Purpose of the lifting device is to uncouple the area with the drive wheels 52 by raising the arranging means 50 at the running rails (not shown) such that the drive motor 51 is no longer able to induce a forward or reverse movement.

The lifting device can be provided with mechanical means such as a hook which can positively engage in a corresponding recess on the arranging means 50. However it is especially preferred to arrange an electromagnet above the arranging means 50, approximately in the area of the drive axis 53, which can act upon a metal component of the arranging means. If the electromagnet is charged with a current, the magnetic forces act upon the corresponding metal component of arranging means 50, for example the metal plate 63. The arranging means 50 is lifted pout accordingly by the magnetic force, and the drive wheels 52 are uncoupled from the running rails. Now, by starting the drive motor 51 and by interaction between the gear wheels 56 and 61, the clamping jaws 59 can be moved into either open or closed position without moving the arranging means 50 in forward direction V or reverse direction R. The travel path otherwise necessary for the opening or closing movement along the press plate 14 can be eliminated. That travel path, which can also be called the shifting travel, within which a package 12 cannot be arranged, is saved by the lifting device. As a result, on the one hand, the width between the supports 13 can be reduced accordingly, such that the strapping arrangement can be narrower. Alternatively, strapping means 10 could be used to process a package 12 that is wider by the width of the shifting travel. In summary, this means that the arranging means, thanks to the lifting device, can take up an edge protection means at the point of departure and can then deposit it on a package edge.

It was thus disclosed how an advantageous arranging means 50 can be designed in which neither a separate drive nor a separate control is necessary because the opening and closing movement is force-controlled via the drive arrangement 51 of the arranging means 50. In addition it was shown that through a lifting device for the arranging means 5, a travel path to the arranging means 50 for opening and closing the clamp mounting can be eliminated.

REFERENCE SIGNS

10 Strapping arrangement
11 Edge protection means
12 Package
13 Support
Press plate
14 Load carrier
15 Packing table
50 Means for arranging edge protection means (arranging means)
51 Drive motor
52 Drive wheel
53 Drive axis
54 Running wheel
55 Guide roller
56 First gear wheel
57 Lever
58 Swivel axis
59 Clamping jaw
60 Counter bearing
61 Rubber bushing
62 Second rubber bushing
63 Metal plate
64 Second gear wheel
K Package edge
X Direction
Y Forward direction
R Reverse direction
H Horizontal distance

The invention claimed is:

1. A device for arranging an edge protector on a package, the device comprising:

a chassis;

at least one drive wheel mounted to the chassis and configured to rotate relative to the chassis and move the chassis along a rail from a point of departure to the package and from the package to the point of departure;

a motor operably connected to the at least one drive wheel and configured to rotate the at least one drive wheel;

a counter bearing mounted to the chassis; and a clamping jaw mounted to the chassis, wherein the motor is operably connected to the clamping jaw via at least one power transmission device and is configured to move the clamping jaw relative to the counter bearing between an open position and a closed position.

2. The device of claim 1, wherein the at least one power transmission device is configured to move the clamping jaw to the closed position when the motor causes the at least one drive wheel to rotate to move the chassis along the rail toward the package and is configured to move the clamping jaw to the open position when the motor causes the at least one drive wheel to rotate to move the chassis along the rail back toward the point of departure.

3. The device of claim 1, wherein the clamping jaw is part of a pivotable lever that is pivotable around a swivel axis.

4. The device of claim 3, further comprising a first end stop positioned to stop the lever from moving when the clamping jaw reaches the open position.

5. The device of claim 4, wherein the at least one power transmission device includes a first gear positioned on an axis of the at least one drive wheel via a slipping clutch configured to discard overload and hold a defined torque when the clamping jaw reaches the open position or the closed position.

6. The device of claim 4, further comprising a second end stop positioned to stop the lever from moving when the clamping jaw reaches the closed position.

7. The device of claim 3, wherein the at least one power transmission device includes a first gear positioned on an axis of the at least one drive wheel.

8. The device of claim 7, wherein the at least one power transmission device further comprises a second gear rotatable around the swivel axis, wherein the first drive gear drivingly engages the second gear.

9. The device of claim 7, wherein the first gear is positioned on the axis of the at least one drive wheel via a slipping clutch configured to discard overload and hold a defined torque when the clamping jaw reaches the open position or the closed position.

10. The device of claim 1, wherein the chassis is part of the motor.

11. A device for strapping packages, the device comprising:

a frame;

a press plate movably mounted to the frame and including a rail;

a packing table positioned below the press plate and at least partially within the frame; and a device for arranging an edge protector on a package positioned on the packing table, the device for arranging the edge protector comprising:

a chassis;

a drive wheel mounted to the chassis and bearing on the rail of the press plate, wherein the drive wheel is configured to rotate relative to the chassis and move the chassis along the rail from a point of departure to the package and from the package to the point of departure;

a motor operably connected to the drive wheel and configured to rotate the drive wheel;

a counter bearing mounted to the chassis; and a clamping jaw mounted to the chassis, wherein the motor is operably connected to the clamping jaw via at least one power transmission device and is configured to move the clamping jaw relative to the counter bearing between an open position and a closed position.

12. The device of claim 11, further including a lifting device configured to lift the device for arranging the edge protector on the package such that the drive wheel does not contact the rail.

13. The device of claim 12, wherein the lifting device comprises an electromagnet configured to be charged with an electric current to induce a magnetic force that acts on a metallic part of the device for arranging the edge protector on the package to lift the device for arranging the edge protector on the package such that the drive wheel does not contact the rail.

14. The device of claim 1, wherein the lifting device comprises a lifting arm configured to engage a lifting element of the device for arranging the edge protector on the package to lift the device for arranging the edge protector on the package such that the drive wheel does not contact the rail.

* * * * *